US009267680B2

(12) United States Patent
Goodson et al.

(10) Patent No.: US 9,267,680 B2
(45) Date of Patent: Feb. 23, 2016

(54) MULTIPLE FUEL COMBUSTION SYSTEM AND METHOD

(71) Applicants: David B. Goodson, Seattle, WA (US); Christopher A. Wiklof, Everett, WA (US)

(72) Inventors: David B. Goodson, Seattle, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 87 days.

(21) Appl. No.: 13/731,109

(22) Filed: Dec. 30, 2012

(65) Prior Publication Data

US 2013/0255548 A1 Oct. 3, 2013

Related U.S. Application Data

(60) Provisional application No. 61/616,223, filed on Mar. 27, 2012.

(51) Int. Cl.

| | |
|---|---|
| ***F23C 99/00*** | (2006.01) |
| ***F23G 5/12*** | (2006.01) |
| ***F23G 7/00*** | (2006.01) |
| *F23G 5/44* | (2006.01) |
| *F23C 5/08* | (2006.01) |
| *F23C 1/02* | (2006.01) |
| *F23C 1/04* | (2006.01) |

(52) U.S. Cl.

CPC ..... *F23C 99/001* (2013.01); *F23B 2900/00006* (2013.01); *F23C 1/02* (2013.01); *F23C 1/04* (2013.01); *F23C 5/08* (2013.01); *F23G 5/12* (2013.01); *F23G 5/442* (2013.01); *F23G 2204/103* (2013.01)

(58) Field of Classification Search

CPC ..... F23C 6/047; F23C 13/00–13/08; F23C 2201/301; F23G 5/12; F23G 5/14; F23G 2204/103

See application file for complete search history.

(56) References Cited

U.S. PATENT DOCUMENTS

| | | | | |
|---|---|---|---|---|
| 1,153,182 | A | 9/1915 | Schniewind | |
| 2,604,936 | A | 7/1952 | Kaehni et al. | |
| 3,087,472 | A | 4/1963 | Asakawa | |
| 3,224,485 | A | 12/1965 | Blomgren et al. | |
| 3,306,338 | A | 2/1967 | Wright et al. | |
| 3,358,731 | A | 12/1967 | Donnelly | |
| 3,416,870 | A * | 12/1968 | Wright | 431/2 |
| 3,503,348 | A | 3/1970 | Dvirka | |
| 3,669,041 | A * | 6/1972 | Schworer | 110/193 |
| 3,749,545 | A | 7/1973 | Velkoff | |
| 3,841,824 | A | 10/1974 | Bethel | |

(Continued)

OTHER PUBLICATIONS

Altendrfner et al., "Electric Field Effects on Emissions and Flame Stability With Optimized Electric Field Geometry", Third European Combustion Meeting ECM 2007, p. 1-6.

(Continued)

*Primary Examiner* — David J Laux

(74) *Attorney, Agent, or Firm* — Christopher A. Wiklof; Nicholas S. Bromer; Launchpad IP, Inc.

(57) ABSTRACT

According to embodiments, a co-fired or multiple fuel combustion system is configured to apply an electric field to a combustion region corresponding to a second fuel that normally suffers from poor combustion and/or high sooting. Application of an AC voltage to the combustion region was found to increase the extent of combustion and significantly reduce soot evolved from the second fuel.

36 Claims, 9 Drawing Sheets

(56) References Cited

U.S. PATENT DOCUMENTS

| | | | | |
|---|---|---|---|---|
| 3,869,362 | A | 3/1975 | Machi et al. | |
| 3,894,834 | A | 7/1975 | Estes | |
| 4,052,139 | A | 10/1977 | Paillaud et al. | |
| 4,091,779 | A | 5/1978 | Saufferer et al. | |
| 4,093,430 | A | 6/1978 | Schwab et al. | |
| 4,110,086 | A | 8/1978 | Schwab et al. | |
| 4,111,636 | A | 9/1978 | Goldberg | |
| 4,118,202 | A | 10/1978 | Scholes | |
| 4,201,140 | A | 5/1980 | Robinson | |
| 4,219,001 | A | 8/1980 | Kumagai et al. | |
| 4,260,394 | A | 4/1981 | Rich | |
| 4,304,096 | A | 12/1981 | Liu et al. | |
| 4,340,024 | A | 7/1982 | Suzuki et al. | |
| 4,439,980 | A | 4/1984 | Biblarz et al. | |
| 4,649,260 | A | 3/1987 | Melis et al. | |
| 4,675,029 | A | 6/1987 | Norman et al. | |
| 4,903,616 | A | 2/1990 | Mavroudis | |
| 4,987,839 | A | 1/1991 | Krigmont et al. | |
| 5,101,742 | A | 4/1992 | Sowards et al. | |
| 5,702,244 | A | 12/1997 | Goodson et al. | |
| 6,640,549 | B1 | 11/2003 | Wilson et al. | |
| 6,736,133 | B2 | 5/2004 | Bachinski et al. | |
| 6,742,340 | B2 | 6/2004 | Nearhoof, Sr. et al. | |
| 6,918,755 | B1 | 7/2005 | Johnson et al. | |
| 7,137,808 | B2 * | 11/2006 | Branston et al. | 431/8 |
| 7,168,427 | B2 | 1/2007 | Bachinski et al. | |
| 7,182,805 | B2 | 2/2007 | Reaves | |
| 7,226,496 | B2 | 6/2007 | Ehlers | |
| 7,226,497 | B2 | 6/2007 | Ashworth | |
| 7,243,496 | B2 * | 7/2007 | Pavlik et al. | 431/2 |
| 7,377,114 | B1 | 5/2008 | Pearce | |
| 7,837,962 | B2 * | 11/2010 | Eiteneer et al. | 110/203 |
| 7,845,937 | B2 | 12/2010 | Hammer et al. | |
| 8,082,725 | B2 | 12/2011 | Younsi et al. | |
| 8,245,951 | B2 | 8/2012 | Fink et al. | |
| 2007/0020567 | A1 | 1/2007 | Branston et al. | |
| 2011/0203771 | A1 | 8/2011 | Goodson et al. | |
| 2012/0317985 | A1 | 12/2012 | Hartwick et al. | |
| 2013/0004902 | A1 | 1/2013 | Goodson et al. | |
| 2013/0071794 | A1 | 3/2013 | Colannino et al. | |
| 2013/0170090 | A1 | 7/2013 | Colannino et al. | |
| 2013/0230810 | A1 | 9/2013 | Goodson et al. | |
| 2013/0230811 | A1 | 9/2013 | Goodson et al. | |
| 2013/0255482 | A1 | 10/2013 | Goodson | |
| 2013/0255548 | A1 | 10/2013 | Goodson et al. | |
| 2013/0255549 | A1 | 10/2013 | Sonnichsen et al. | |
| 2013/0260321 | A1 | 10/2013 | Colannino et al. | |

OTHER PUBLICATIONS

William T. Brande; "The Bakerian Lecture: On Some New Electro-Chemical Phenomena", Phil. Trans. R. Soc. Lond. 1814 104, p. 51-61.

James Lawton and Felix J. Weinberg. "Electrical Aspects of Combustion". Clarendon Press, Oxford. 1969.

PCT International Search Report and Written Opinion of PCT Application No. PCT/US2012/072251 mailed Mar. 7, 2013.

* cited by examiner

NO VOLTAGE APPLIED

300 HZ 10kV Neg

NO VOLTAGE APPLIED

1000 HZ 10kV Neg

NO VOLTAGE APPLIED

300 HZ 10kV Neg

NO VOLTAGE APPLIED

1000 HZ 10kV Neg

NO VOLTAGE APPLIED

300 HZ 10kV Neg

NO VOLTAGE APPLIED

1000 HZ 10kV Neg

NO VOLTAGE APPLIED

300 HZ 10kV Neg

NO VOLTAGE APPLIED

1000 HZ 10kV Neg

NO VOLTAGE APPLIED

300 HZ 10kV Neg

NO VOLTAGE APPLIED

1000 HZ 10kV Neg

NO VOLTAGE APPLIED

300 HZ 10kV Neg

NO VOLTAGE APPLIED

1000 HZ 10kV Neg

MULTIPLE FUEL COMBUSTION SYSTEM AND METHOD

CROSS REFERENCE TO RELATED APPLICATIONS

The present application claims priority benefit from U.S. Provisional Patent Application No. 61/616,223, entitled "MULTIPLE FUEL COMBUSTION SYSTEM AND METHOD", filed Mar. 27, 2012; which, to the extent not inconsistent with the disclosure herein, is incorporated by reference.

SUMMARY

According to an embodiment, electro-dynamic and/or electrostatic fields may be applied to a co-fired combustion system to enhance combustion property(ies). In an example system, a bench-top scale model selectively introduced an AC field across a simulated tire-derived fuel (TDF) (a cut up bicycle inner-tube) held in a crucible over a propane pre-mixed flame. Without the electric field, the simulated TDF smoked profusely. With the electric field turned on, there was not any visible soot (although instrumentation detected a low level of soot). A cause and effect relationship was established by repeatedly turning on and turning off the electric fields. There was no observable hysteresis effect–switch on=no visible soot, switch off=visible soot.

According to an embodiment, a co-fired combustion apparatus may include a first fuel-introduction body defining a portion of a first combustion region. This may correspond to the premix nozzle and a flame region, for example. The first combustion region may be configured to combust a first fuel (e.g., propane) in a first combustion reaction. The apparatus may also include a second fuel-introduction body defining at least a portion of second combustion region. For example, the second fuel-introduction body may include the crucible described above. The second combustion region may be configured to combust a second fuel in a second combustion reaction. The first combustion reaction may be operable to sustain the second combustion reaction. For example, the simulated TDF was not readily ignited until heated by the propane flame. An electrode assembly associated with the second combustion region may be operable to be driven to or held at one or more first voltages. In the example above, the electrode assembly included the metallic crucible itself. A grounded 4-inch stack that was located approximately axial to the crucible may be envisioned as providing an image charge that varied to solve a field equation driven by the AC waveform.

Accordingly to another embodiment, a method of co-fired combustion may include maintaining the first combustion reaction by combusting the first fuel at the first combustion region. In other words, the propane combustion reaction $C_3H_8+5\ 0_2 \rightarrow 3\ C0_2+4\ H_20$ may be a self-sustaining exothermic reaction. The first combustion region may have a portion thereof defined by the first fuel-introducing body. The method may further include maintaining a second combustion reaction by combusting a second fuel at a second combustion region having a portion defined by a second fuel-introducing body. The second combustion may be sustained by the first combustion reaction. According to embodiments, the method includes applying at least one first electrical potential (which may include a time-varying electrical potential) proximate the second combustion region.

DETAILED DESCRIPTION

Figure 1:
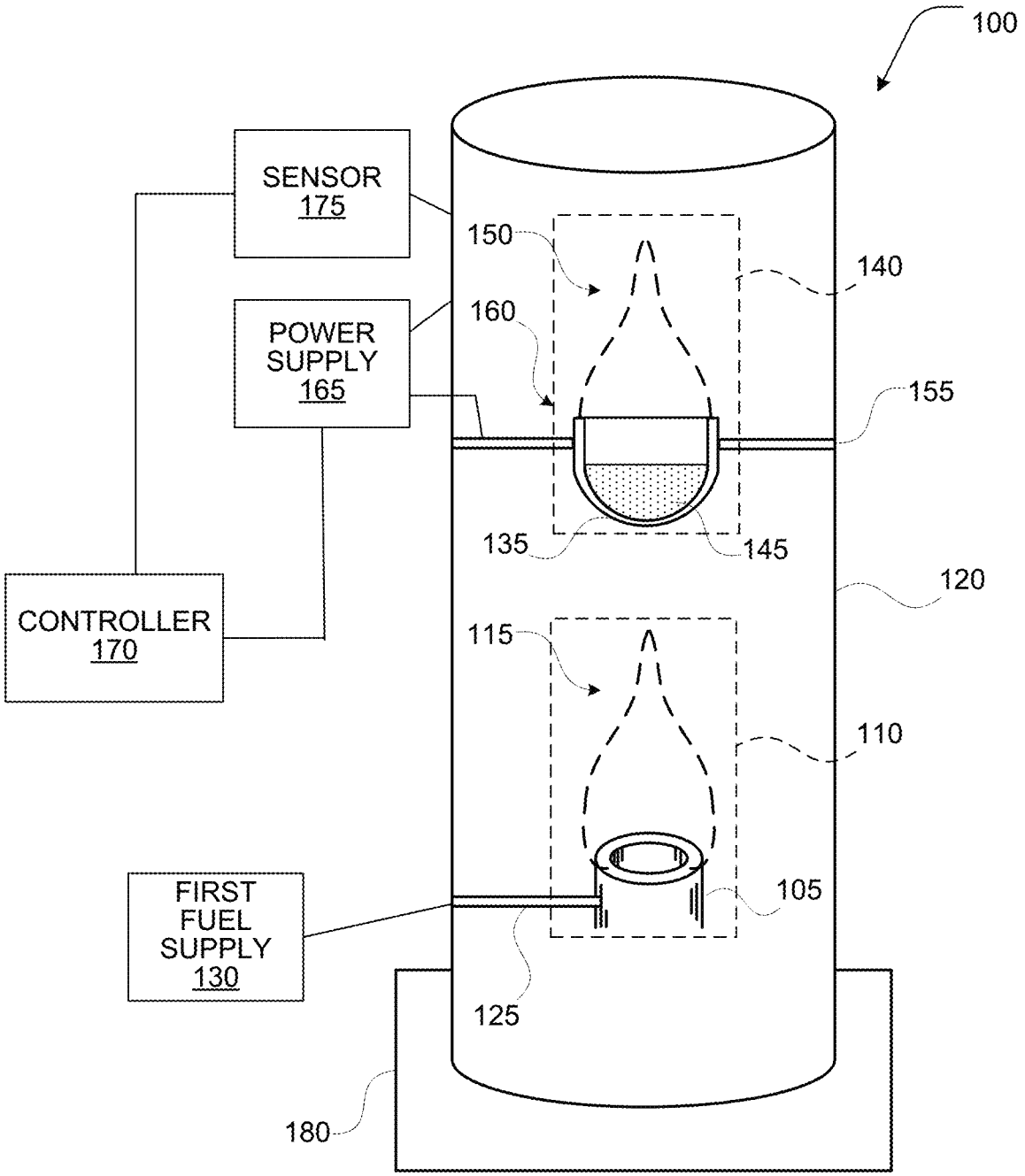
FIG. 1 is a diagram of a co-fired combustion apparatus, according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

FIG. 1 is a diagram of a co-fired combustion apparatus 100, according to an embodiment. The apparatus 100 may include a first fuel-introduction body 105 defining a portion of first combustion region 110. The first combustion region 110 may be configured to combust a first fuel (not shown) in a first combustion reaction 115. In an embodiment, the first fuel-introduction body 105 may be supported in a housing 120 by a first fuel-introduction-body support 125. The first fuel may be provided by a first fuel supply 130. The first fuel may be substantially liquid or gaseous. For example, the first fuel may include at least one of natural gas, propane, oil, or coal. In an embodiment, the first fuel-introduction body 105 may comprise a burner assembly that is configured to support a flame.

A second fuel-introduction body 135 may define a portion of a second combustion region 140. The second combustion region 140 may be configured to combust a second fuel 145 in a second combustion reaction 150. In an embodiment, the second fuel-introduction body 135 may comprise a crucible assembly, which may be operable to hold the second fuel 145. Alternatively, the second fuel-introduction body 135 may include a grate, a screen, a fluidized bed support, or another apparatus configured to introduce, contain and/or hold the second fuel 145 proximate the second combustion region 140. The second fuel-introduction body 135 may be supported in the housing 120 by a second fuel-introduction-body support 155. In an embodiment, the second fuel 145 may be substantially solid under standard conditions. The second fuel 145 may melt, melt and vaporize, sublime, and/or be dried responsive to heating from the first combustion reaction 115. In an embodiment, the second fuel 145 may include one or more of rubber, wood, glycerin, an industrial waste stream, a post-consumer waste stream, an industrial by-product, garbage, hazardous waste, human waste, animal waste, animal carcasses, forestry residue, batteries, tires, waste plant material, or landfill waste. In an embodiment, the second fuel 145 may be fluidized to form at least a portion of a fluidized bed.

In an embodiment, the first combustion reaction 115 may sustain the second combustion reaction 150. For example, the first combustion reaction 115 may generate heat which initiates or supports the second combustion reaction 150. Accordingly, in an embodiment, the first fuel-introduction body 105 may be positioned at a distance proximate to the second fuel-introduction body 135 so that the first combustion reaction 115 may support the second combustion reaction 150. In an embodiment, a portion of the apparatus 100 may be enclosed within a flue, stack, or pipe configured to convey at least a portion of a combustion product stream generated by the first and/or second combustion reactions 115, 150.

According to an embodiment, the first combustion region 110 may be substantially separated from the second combustion region 140. According to another embodiment, the first combustion region 110 may extend to overlap or occupy the entirety of the second combustion region 140. According to an embodiment, the first combustion reaction 115 may provide ignition for the second combustion reaction 150.

An electrode assembly 160 associated with the second combustion region 140 may be operable to be driven to or held at one or more first voltages such as a constant (DC) voltage, a modulated voltage, an alternating polarity (AC) voltage, or a modulated voltage with a DC voltage offset. In an embodiment, the electrode assembly 160 may comprise at least a portion of one or more of the second fuel-introduction body 135, the second fuel-introduction-body support 155, the housing 120, or an electrode (not shown) separate from the second fuel-introduction body 135, the second fuel-introduction body support 155, and the housing 120. In an embodiment, any of the second fuel-introduction body 135, the second fuel-introduction-body support 155, the housing 120, or a separate electrode assembly 160 may each be configured to be driven to or held at one or more voltage(s), which may or may not be the same voltage. For example, the housing 120 may be held at a ground voltage and the second fuel-introduction-body support 155 may be held at or driven to positive and/or negative voltages. In an embodiment, the housing 120 may rest on a grounding plate 180, which may ground the housing 120.

It was found that the smoke reduction was most pronounced when the first voltage included a high voltage greater than +1000 volts and/or less than −1000 volts. For example, in experiments, the voltage was an AC waveform with amplitude of +/−10 kilovolts. Other high voltages may be used according to preferences of the system designer and/or operating engineer.

The electrode assembly 160 may be configured to be driven to or held at a voltage produced by a voltage source including a power supply 165. The power supply 165 may be operatively coupled to controller 170, which is configured to drive or control the electrode assembly 160. In some embodiments, the electrode assembly 160 may include one or more electrodes positioned proximate to the second combustion region 140, which may or may not directly contact the second fuel-introduction body 135 or the second fuel 145. Such electrodes may be positioned in any desirable arrangement or configuration. In an embodiment, a portion of the first fuel-introduction body 105, a portion of the first fuel-introduction-body support 125, or a portion of an electrode (not shown) proximate to the first combustion region 110 may be configured to be held at one or more second voltage(s).

The apparatus 100 may optionally include one or more sensor(s) 175 operable to sense one or more conditions of the apparatus 100, components thereof, and/or the second fuel 145 combustion reaction 150. For example, a sensor 145 may sense heat, voltage, fluid flow, fluid turbulence, humidity, particulate matter, or one or more compounds or species. In an embodiment, the sensor 175 may be used to sense the condition or state of a combustion product stream generated by the second combustion reaction 150. A sensed state or condition of the combustion product stream generated by the second combustion reaction 150 may be used by a feedback controller 170 to modify or modulate the one or more voltages and/or waveforms that the electrode assembly 160 is held at or driven to.

For example, as further discussed herein, driving or holding the electrode assembly 160 at one or more voltages may affect the second combustion reaction 150. Driving or holding the electrode assembly 160 at one or more voltages may modify the efficiency, rate, thermal output, or turbulence, of the second combustion reaction 150. The sensor(s) 175 may be operable to detect such effects.

It was found that applying an electric field proximate to a combustion reaction may be used to improve the efficiency of the combustion reaction. The improvement in efficiency may include a reduction in undesirable combustion products such as unburned fuel, oxides of sulfur ($SO_X$), oxides of nitrogen ($NO_X$), hydrocarbons, and other species. Additionally, the improvement in efficiency may include an increase in thermal energy generated by the combustion reaction per the amount of fuel. In addition to being less harmful to the environment, supporting a cleaner combustion reaction may result in lower operating expense. Discharge of certain combustion pollutants may require the purchase of emission-permits for an amount of pollutant discharge. Reducing pollutant discharge in a given reaction may therefore allow a business to obtain fewer emission-permits and/or output more heat at a reduced cost. Additionally or alternatively, less fuel may be consumed to generate an equivalent amount of energy.

Increased efficiency of a combustion reaction may occur via one or more mechanisms. For example, applying an electric field proximate to a combustion reaction may increase the number of collisions between reactants, which may increase the reaction rate. In one example, applying an electric field proximate to a combustion reaction may increase the collision energy of reactants and therefore increase the rate of reaction. In another example, applying an electric field proximate to a combustion reaction may provide a self-catalysis effect for various desirable reactions and may reduce the reaction activation energy by urging reactants to come together in a correct reaction orientation. In a further example, applying an electric field proximate to a combustion reaction may increase the turbulence of a reaction and thereby increase the mixture or introduction rate of reactants (e.g., increased mixing of oxygen with fuel), which may promote a more efficient or complete combustion reaction (e.g., where reactants combust to produce a greater proportion of desired reaction products, fewer unreacted reactants and undesired products or by-products of the combustion reaction will be emitted).

Figure 2:
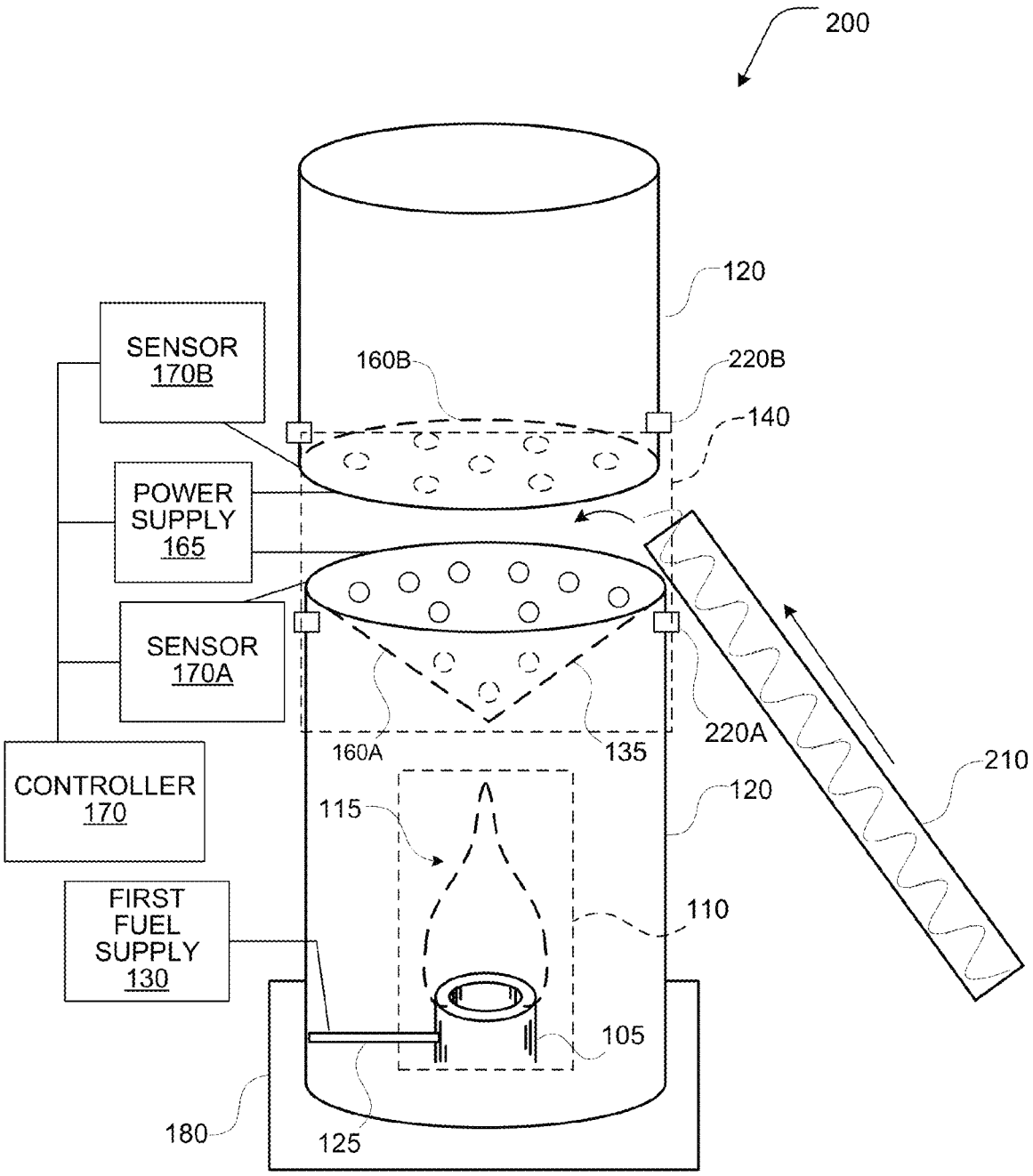
FIG. 2 is a diagram of a co-fired combustion apparatus, according to an embodiment.

FIG. 2 is a diagram of a co-fired combustion apparatus 200, according to an embodiment. The apparatus 200 may include a first fuel-introduction body 105 defining a portion of first combustion region 110. The first combustion region 110 may be configured to combust a first fuel from a first fuel supply 130 in a first combustion reaction 115. In an embodiment, the first fuel-introduction body 105 may be supported in a housing 120 by a first fuel-introduction-body support 125.

The apparatus 200 may also include a second fuel-introduction body 135 defining a portion of a second combustion region 140. The second combustion region 140 may be configured to combust a second fuel (not shown) in a second combustion reaction (not shown). In an embodiment, the second fuel-introduction body 135 may comprise a crucible assembly, which may be configured to hold the second fuel. Alternatively, the second fuel-introduction body 135 may include a grate, a screen, a fluidized bed support, or another apparatus configured to introduce and/or contain or hold the second fuel proximate the second combustion region 140. The apparatus may also include a stoker 210, configured to introduce the second fuel to the fuel-introduction body 135.

For example, in an embodiment, the second fuel may comprise timber waste products, and the stoker 210 may be configured to convey timber waste products into the fuel-introduction body 135 so that sufficient second fuel is present to sustain a relatively constant combustion fuel volume within the second fuel-introduction body 135. For example, as the second fuel is consumed, additional second fuel may be introduced by the stoker 210 so that the second combustion reaction may continue. Optionally, the second fuel-introduction body 135 may include a containment body 1608 configured to prevent entrainment of unburned second fuel particles in flue gas exiting through the top of the body 120.

In another embodiment, the second fuel may include black liquor, such as a residue from a sulfite pulp mill. The stoker 210 may be configured to convey liquid or semi-solid black liquor to the second combustion region 140.

Optionally, the burner 200 may include a heat recovery system including one or more heat transfer surfaces such as water tube boiler tubes to convert heat output by the second (not shown) and/or first combustion reaction 115 to heated water or steam. According to an embodiment, the application of electrical energy to at least the second combustion reaction (not shown) may reduce tendency for combustion byproducts or entrained materials to be deposited on heat transfer surfaces. This may allow a longer operating duration between service shut-downs to clean heat transfer surfaces.

A first and second electrode assembly 160A, 160B associated with the second combustion region 140 may be operable to be driven to or held at one or more voltages using a substantially constant (DC) voltage, a modulated voltage, an alternating polarity (AC) voltage, or a modulated voltage with DC voltage offset. The first electrode 160A assembly may be configured to be driven to or held at one or more first voltages. The second electrode 1608 assembly may be configured to be driven to or held at one or more second voltages. In an embodiment, the first and second one or more voltages may be the same.

The first and second electrode assemblies 160A, 160B may be electrically isolated from a portion of the housing 120 via respective insulators and/or air gaps 220A, 220B. In an embodiment, the first and second electrode assembly 160A, 160B may be held or driven to a first and second voltage respectively, and the housing 120 may be held at or driven to a third voltage. For example, the housing 120 may be held at ground potential via a grounding plate 180.

The first and second electrode assembly 160A, 160B may each be configured to be driven to or held at a voltage produced by a voltage source including a power supply 165. The power supply 165 may be operatively coupled to controller 170, which may be configured to control the output voltage, current, and/or waveform(s) output by the power supply 165 to the first and/or second electrode assemblies 160A, 160B.

The apparatus 200 may optionally include a first and/or second sensor 170A, 1708 operable to sense one or more conditions of the apparatus 200 or components thereof. For example, the first sensor 170A may be associated with the first electrode assembly 160A, and the second sensor 1708 may be associated with the second electrode assembly 160B.

Figure 3:
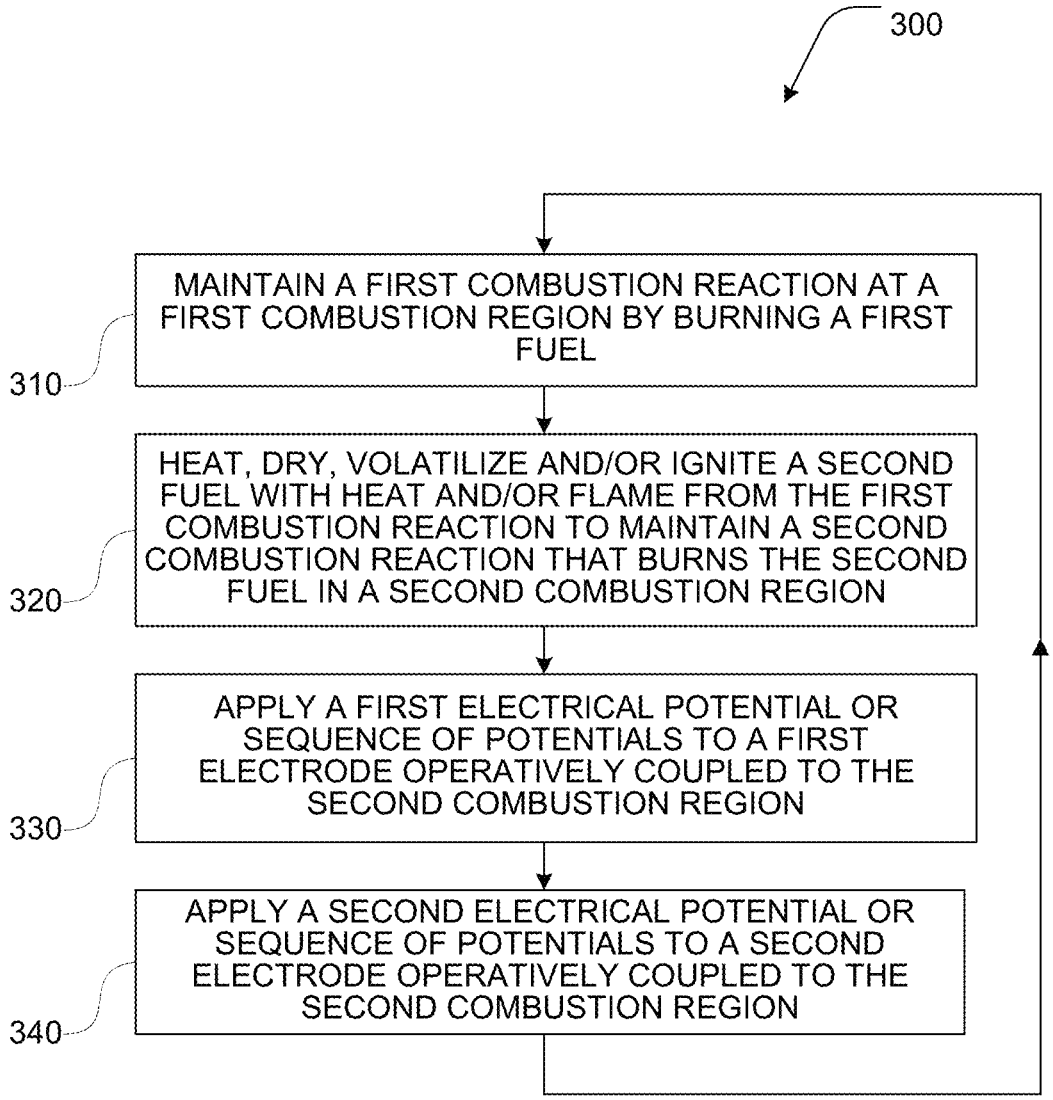
FIG. 3 is a flow chart of a co-fired combustion method, according to an embodiment.
Figure 4:
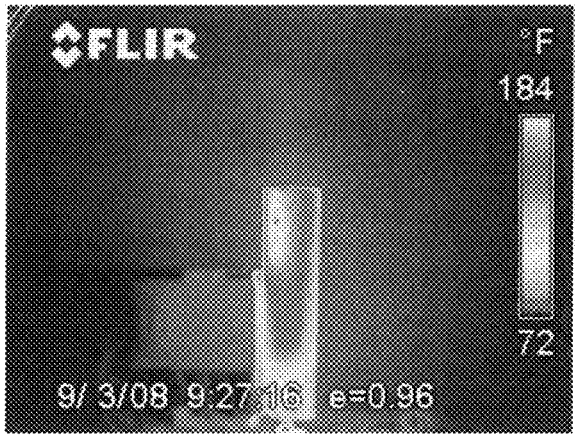
FIGS. 4-27 are thermographic images captured during a heat-exchange experiment wherein a voltage was applied to and removed over time from a crucible supporting a combustion, according to embodiments.
Figure 5:
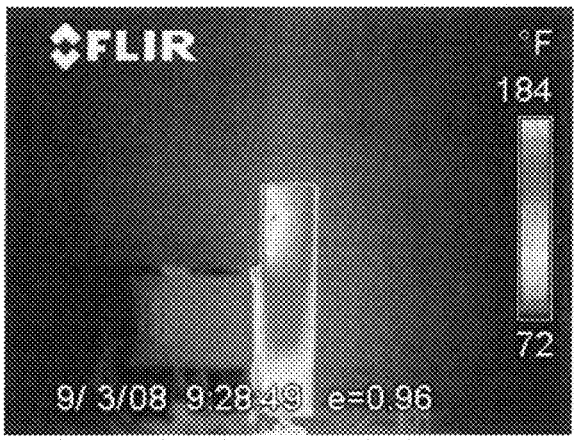
Figure 6:
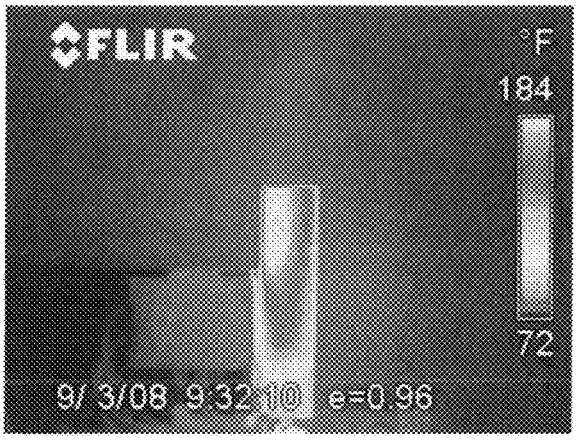
Figure 7:
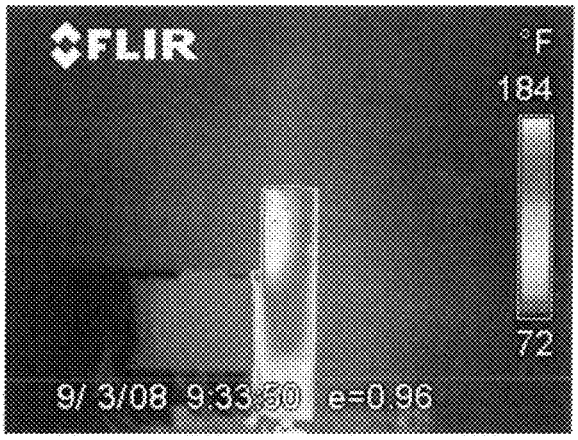
Figure 8:
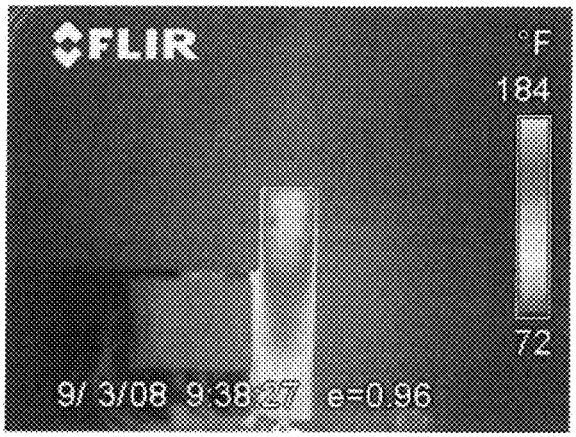
Figure 9:
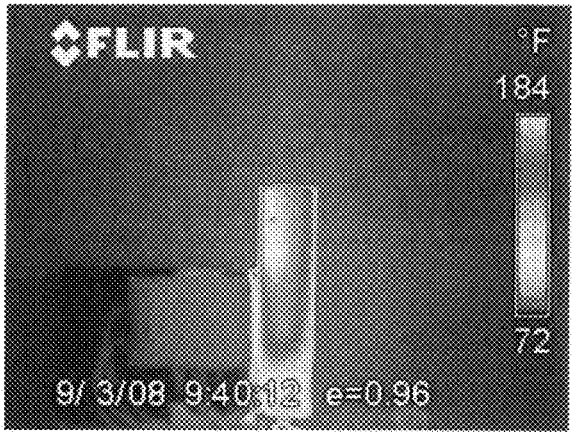
Figure 10:
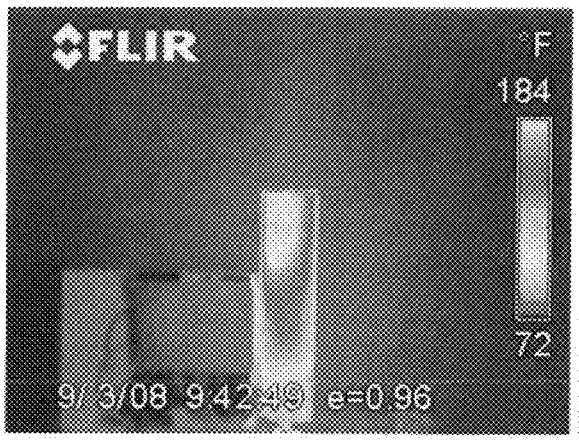
Figure 11:
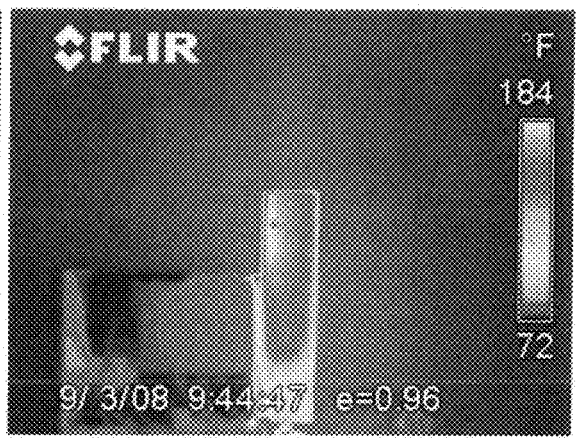
Figure 12:
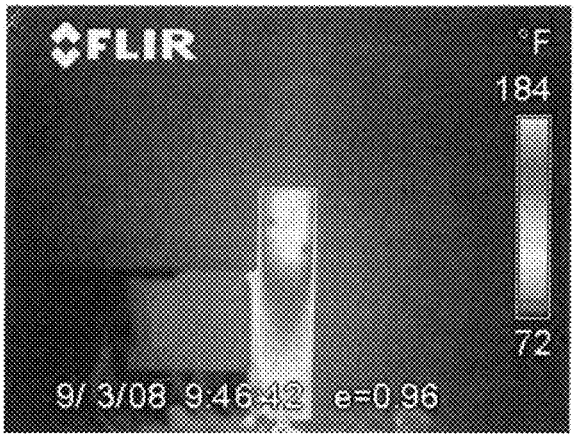
Figure 13:
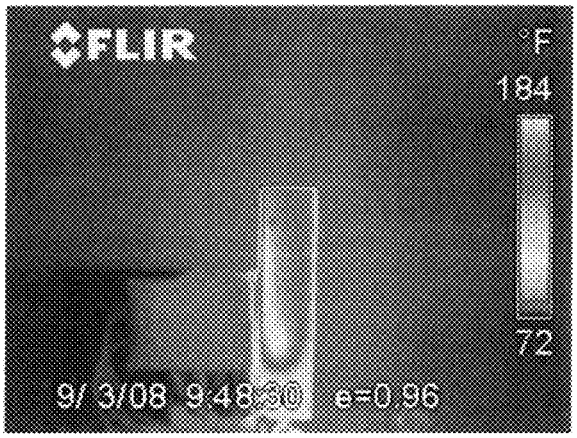
Figure 14:
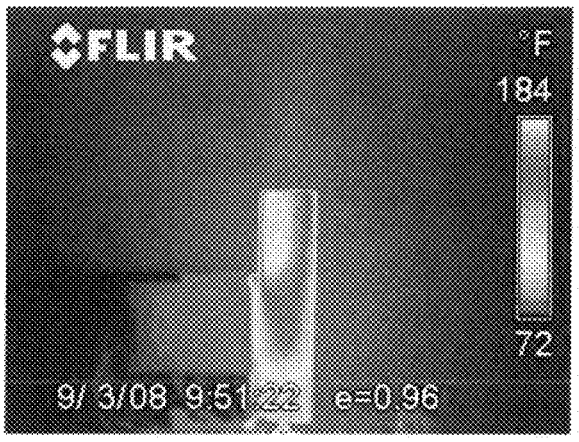
Figure 15:
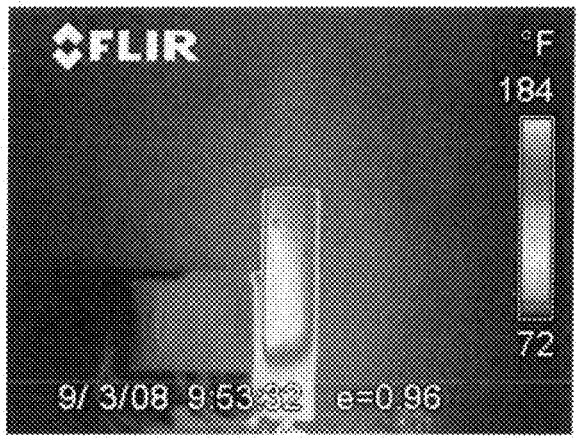
Figure 16:
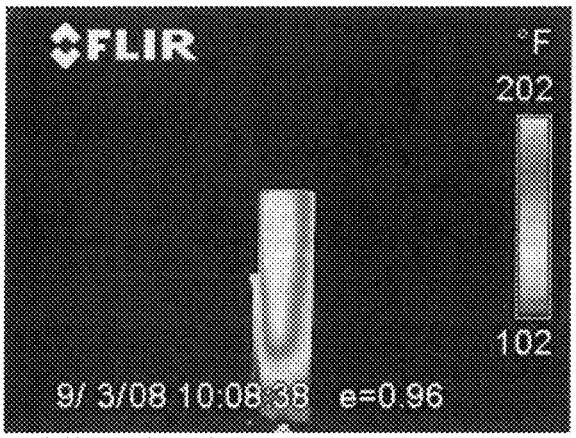
Figure 17:
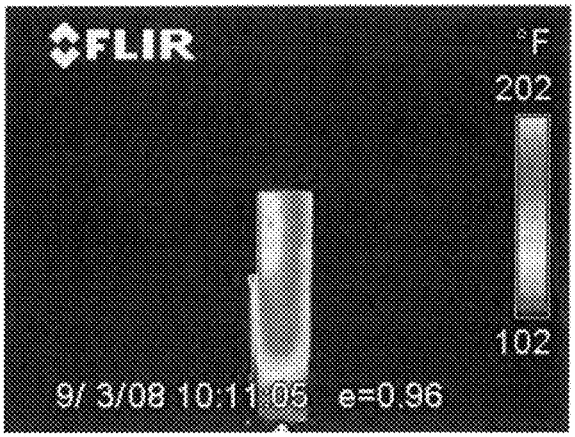
Figure 18:
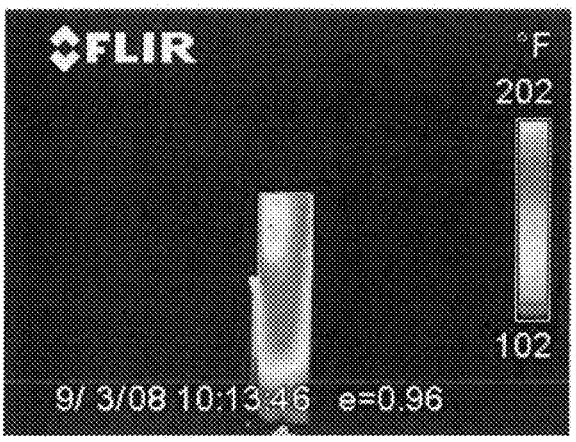
Figure 19:
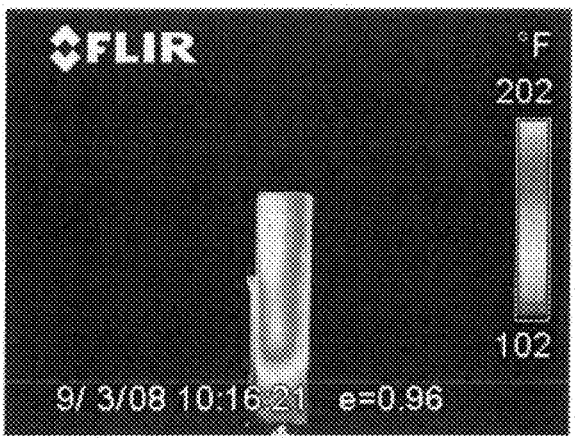
Figure 20:
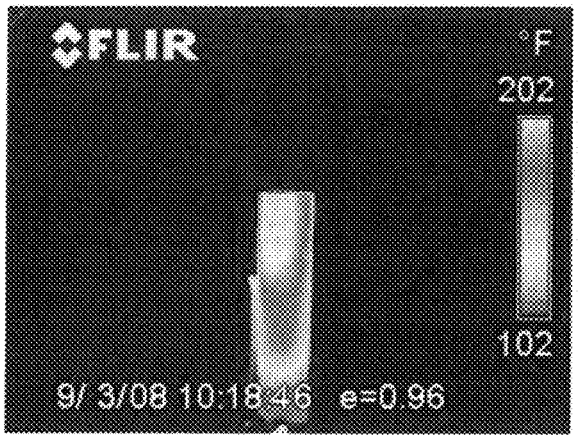
Figure 21:
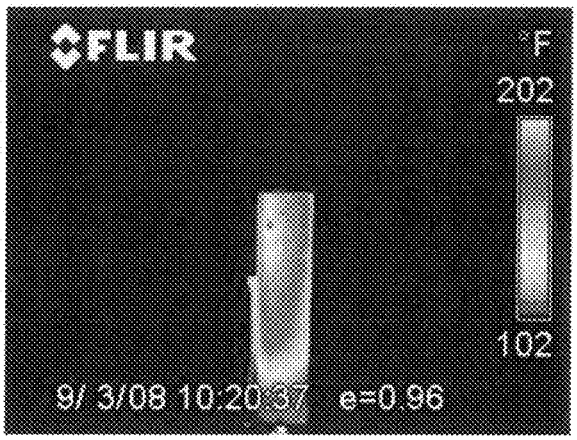
Figure 22:
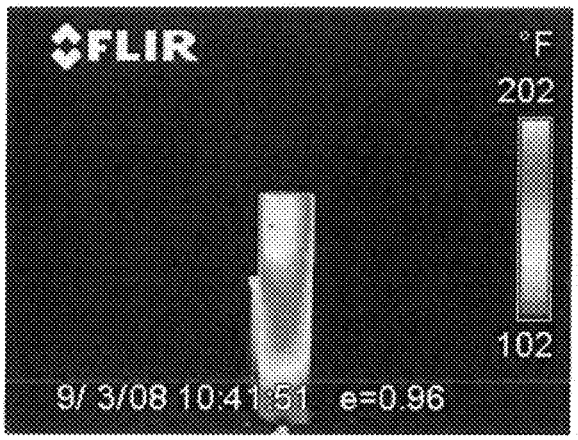
Figure 23:
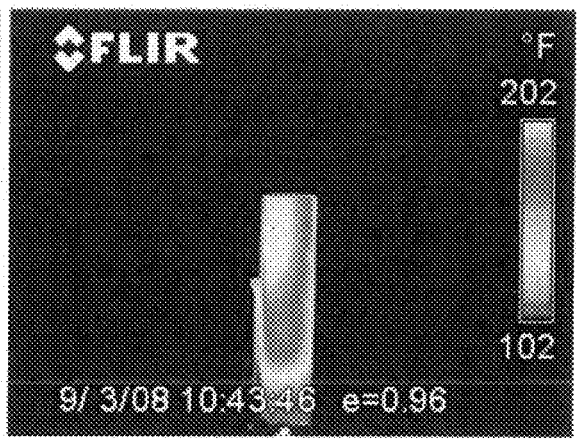
Figure 24:
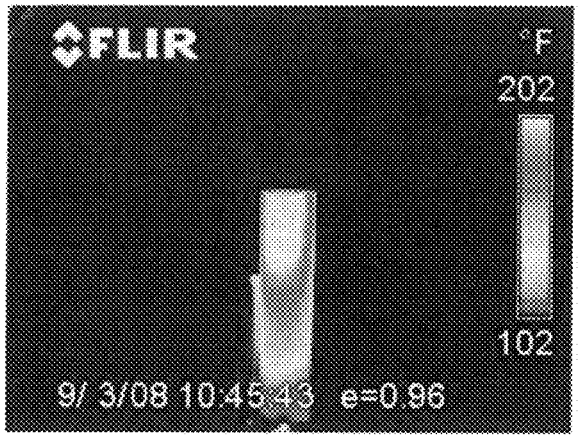
Figure 25:
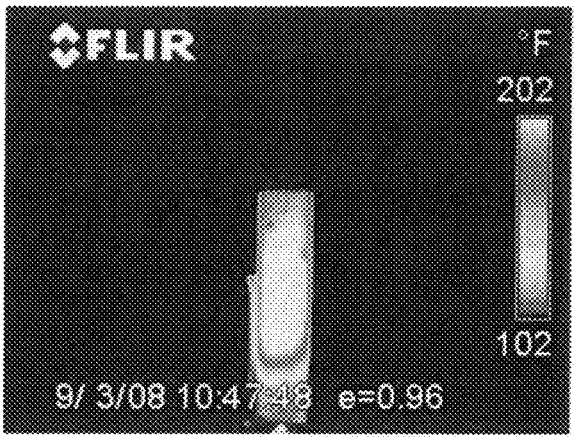
Figure 26:
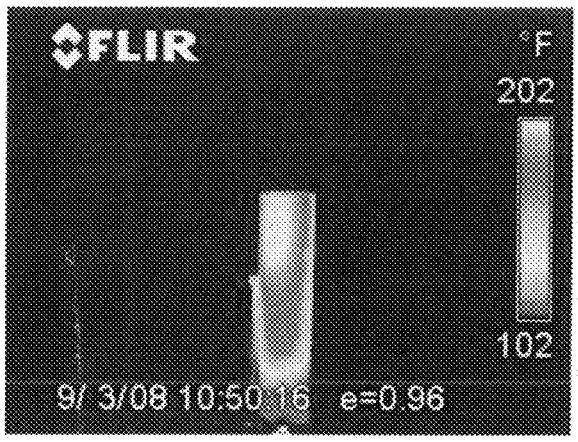
Figure 27:
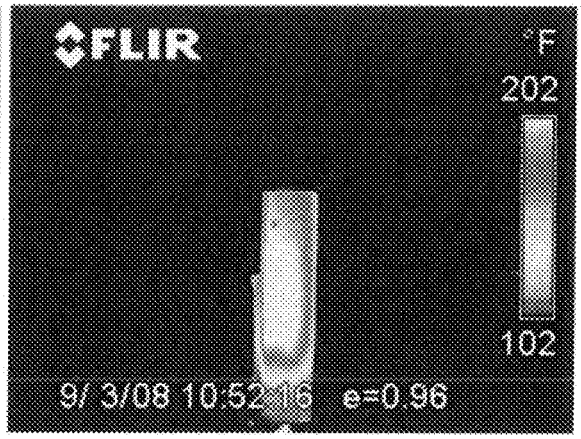

FIG. 3 is a flow chart showing a method 300 for operating a co-fired combustion system, according to an embodiment. The method 300 begins in block 310 where a first combustion is maintained at a first combustion region by combusting a first fuel. For example, referring to FIGS. 1 and 2, the first combustion 115 may be maintained at the first fuel-introduction body 105 in the first combustion region 110. The first fuel may be a relatively free-burning fuel such as a hydrocarbon gas, a hydrocarbon liquid, or coal. The first fuel should be chosen to have a flame temperature that is sufficiently high to support and/or ignite combustion of the second fuel.

The method 300 continues in block 320, where a second combustion reaction is sustained by heat and/or ignition from the first combustion reaction. The second combustion reaction may be maintained at a second combustion region by combusting the second fuel. For example referring to FIGS. 1 and 2, the second combustion reaction 150 may be sustained by the first combustion reaction 115, at the second fuel-introduction body 135 in the second combustion region 140. According to an embodiment, heat from the first combustion reaction may dry, volatilized, and/or raise a vapor pressure of the second fuel sufficiently to allow the second fuel to burn. Additionally or alternatively, the first combustion region may overlap with or contain the second combustion region. The first combustion reaction may provide ignition and/or maintain combustion of the second fuel.

The method 300 continues in block 330 where a first potential or sequence of potentials is applied to a first electrode operatively coupled to the second combustion region. For example, referring to FIG. 1 a first potential or sequence of potentials may be applied to the electrode assembly 160 proximate to the second combustion region 140. Referring to FIG. 2, a first potential may be applied to the first electrode assembly 160A proximate to the second combustion region 140. According to an embodiment, the first potential or sequence of potentials may include a substantially constant (DC) voltage, a modulated voltage, an alternating polarity (AC) voltage, or a modulated voltage with DC voltage offset.

The method 300 continues in block 340, where a second electrical potential or sequence of potentials is applied to a second electrode operatively coupled to the second combustion region. For example, referring to FIG. 1 a second potential may be applied to the housing 120 proximate to the second combustion region 140. Referring to FIG. 2, a second potential may be applied to the second electrode assembly 160B proximate to the second combustion region 140.

The electrical potentials applied in steps 330 and 340 may be selected to cause an increase in reaction rate and/or an increase in the reaction extent reached by the second combustion reaction. According to an embodiment, the first electrical potential or sequence of potentials may include a time-varying high voltage. The high voltage may be greater than 1000 volts and/or less than −1000 volts. According to an embodiment, the high voltage may include a polarity-changing waveform with an amplitude of +/1 10,000 volts or greater. The waveform may be a periodic waveform having a frequency of between 50 and 300 Hertz, for example. In another example, the waveform may be a periodic waveform having a frequency of between 300 and 1000 Hertz. According to an embodiment, the second electrical potential may be a substantially constant (DC) ground potential.

The method is shown looping from step 340 back to step 310. In a real embodiment, the steps 310, 320, 330, and 340 are generally performed simultaneously and continuously while the second fuel is being burned (after start-up and before shut-down).

EXAMPLE

Referring to FIG. 1, a burner assembly 105 was disposed within a cylindrical housing 120, defining a first combustion region 110. The burner assembly 105 was operatively connected to a propane gas supply (first fuel supply 130), which was used to sustain a propane flame on the burner assembly 105 in a first combustion 115. The housing 120 was approximately 3 inches in diameter and approximately 1 foot tall. The burner assembly 105 was substantially cylindrical having a diameter of approximately ¾ inch, and a height of approximately 1 inch.

A crucible 135 having a diameter of approximately ¾ inch was positioned within the housing 120 above the propane first combustion 115. The crucible 135 held a mass of rubber pieces (second fuel 145), which were obtained by cutting pieces from a bicycle inner-tube. The propane first combustion 115 caused the rubber pieces to ignite, thus generating a second combustion 150. The second combustion 150 of the rubber pieces generated a combustion product stream (not shown), which visually presented as black smoke. The housing 120 was used to contain and direct the combustion product stream, and rested on a grounding plate 180, which held the housing 120 at a ground voltage.

A modulated voltage of 10 kV was then applied to the crucible 135 at a frequency of 300-1000 Hz. The smoke generated by the combustion of the rubber pieces changed from a black smoke to no visible smoke. This indicated that the combustion product stream included fewer particulates. The voltage was removed from the crucible 135 and the combustion product stream again presented as black smoke. The voltage was again applied to the crucible 135 and the combustion product stream again presented as a lighter or substantially no visible smoke.

In a first particulate-residue trial, a first volume of rubber pieces was burned in the crucible 135 and a first paper filter was positioned on the top end of the housing 120 to collect particulate matter in the combustion product stream. A voltage was not applied to the crucible 135.

In a second particulate-residue trial, a second volume of rubber pieces (having substantially the same mass as the first volume of the first trial) was burned in the crucible 135 and a second paper filter was positioned on the top end of the housing 120 to collect particulate matter. A modulated voltage of 10 kV was then applied to the crucible 135 at a frequency of 300-1000 Hz.

The first and second filter papers were compared, and the first filter paper exhibited a substantial layer of black particulate matter. The second filter paper on exhibited a light discoloration of the paper, but did not have a layer of particulate matter. This result further indicated that the application of the voltage created a substantial reduction in particulate matter in the combustion product stream of the combusting rubber pieces.

In a first heat-exchange trial, a first volume of rubber pieces was burned in the crucible 135 and thermographic images of the combustion were recorded over time using a Fluke Ti20 Thermal Analyzer at a perspective substantially the same as the perspective of FIG. 1. A propane fuel volume of 0.4 actual cubic feet per hour (acfh) was supplied to the burner assembly 105 during the trial. A voltage was not applied to the crucible 135.

In a second heat-exchange trial, a second volume of rubber pieces (having substantially the same mass as the first volume of the first trial) was burned in the crucible 135 and thermographic images of the combustion were recorded over time using a Fluke Ti20 Thermal Analyzer at a perspective substantially the same as the perspective of FIG. 1. A propane fuel volume of 0.2 actual cubic feet per hour (acfh) was supplied to the burner assembly 105 during the trial (i.e., half of the fuel compared to the first trial). A modulated voltage of 10 kV was then applied to the crucible 135 at a frequency of 300-1000 Hz.

The thermographic images of the first and second heat-exchange trial were compared over time. At 15 seconds, both burners registered approximately 130° F. At 45 seconds the first heat-exchange trial continued to register 130° F.; the second heat-exchange trial burner (with 50% fuel) registered approximately 186° F. These trials indicated that even with 50% fuel volume, application of a voltage to the crucible 135 generated a higher combustion temperature.

In a third heat-exchange trial, a volume of rubber pieces was burned in the crucible 135 and thermographic images of the combustion were recorded over time using a Fluke Ti20 Thermal Analyzer at a perspective substantially the same as the perspective of FIG. 1. Over time, a modulated voltage of 10 kv was then applied to the crucible 135 at a frequency of 300 Hz for a period of time; the voltage was removed for a period of time; a modulated voltage of 10 kv was then applied to the crucible 135 at a frequency of 1000 Hz for a period of time; and the voltage was removed for a period of time. The application and removal of these voltages was repeated six times. An image was captured at the end of each period.

FIGS. 4-27 depict the thermographic images captured during the heat-exchange trial from a time of 9:27:16 until 10:52:16 and show that application of a voltage to the crucible 135 generated a higher combustion temperature.

Schlieren photography was used to visualize the flow of the combustion product stream generated by the combustion of rubber pieces within the crucible 135. When no voltage was applied to the crucible 135, the flow of the combustion product stream appeared to be laminar flow; however, when a modulated voltage of 10 kV was then applied to the crucible 135 at a frequency of 300-1000 Hz, the combustion product stream appeared to have turbulent flow. In other words, the combustion product stream behaved according to a low Reynolds number, laminar flow regime when no voltage was applied, and exhibited a high amount of turbulence evocative of a high Reynolds number when a voltage was applied, even though mass flow rates were nearly identical.

While various aspects and embodiments have been disclosed herein, other aspects and embodiments are contemplated. The various aspects and embodiments disclosed herein are for purposes of illustration and are not intended to be limiting, with the true scope and spirit being indicated by the claims.

What is claimed is:

1. A co-fired combustion apparatus, comprising:

a first fuel-introduction body configured to provide a gaseous or liquid first fuel to a first combustion reaction;

a crucible;

a second fuel-introduction body configured to provide a second fuel to a second combustion reaction in the crucible, wherein the first fuel introduction body is positioned below the second fuel introduction body to cause the first combustion reaction to at least intermittently provide heat to the second combustion reaction; and an electrode assembly associated with the second fuel introduction body or a second combustion volume to which the second fuel introduction body provides the second fuel, the electrode assembly being configured to be driven to or maintained at one or more first voltages selected to provide an electric field to the second combustion volume;

wherein the first fuel assembly is configured to produce a flame temperature that is sufficiently high to ignite combustion of the second fuel when a reaction activation energy of the second combustion reaction is reduced by application of the first voltage.

2. The co-fired apparatus of claim 1, wherein the electrode assembly includes one or more electrodes proximate or within the second combustion region.

3. The co-fired apparatus of claim 1, wherein the electrode assembly includes the second fuel-introduction body.

4. The co-fired apparatus of claim 1, wherein a portion of the apparatus is enclosed within a housing.

5. The co-fired apparatus of claim 4, wherein a portion of the housing is operable to be driven to or held at one or more second voltages.

6. The co-fired apparatus of claim 4, wherein the electrode assembly comprises a portion of the housing.

7. The co-fired apparatus of claim 1, wherein the electrode assembly comprises the second fuel-introduction body.

8. The co-fired apparatus of claim 1, wherein the electrode assembly comprises the crucible.

9. The co-fired apparatus of claim 1, wherein the first fuel-introduction body comprises a burner assembly.

10. The co-fired apparatus of claim 1, wherein the first fuel-introduction body is operable to be driven to or held at one or more second voltages.

11. The co-fired apparatus of claim 1, wherein the electrode assembly associated with the second combustion region is operable to increase combustion efficiency of the second combustion when the electrode assembly is driven to or held at the one or more first voltages.

12. The co-fired apparatus of claim 1, wherein the second combustion produces a combustion product stream having a flow; and wherein the electrode assembly associated with the second combustion region is operable to generate a combustion product stream flow having turbulent flow when the electrode assembly is driven to or held at the one or more first voltages.

13. The co-fired apparatus of claim 1, wherein the second fuel is substantially solid.

14. The co-fired apparatus of claim 13, wherein the second fuel forms a portion of a fluidized bed.

15. The co-fired apparatus of claim 1, further comprising a stoker configured to introduce the second fuel to the second combustion region.

16. The co-fired apparatus of claim 1, wherein a portion of the apparatus is enclosed within a flue, stack, or pipe configured to convey a combustion product stream generated by at least the second combustion.

17. The co-fired apparatus of claim 1, wherein the first fuel includes at least one of natural gas, propane, butane, coal, or oil.

18. The co-fired apparatus of claim 1, wherein the second fuel includes one or more of rubber, wood, glycerin, an industrial waste stream, a post-consumer waste stream, an industrial by-product, garbage, hazardous waste, human waste, animal waste, animal carcasses, forestry residue, batteries, tires, waste plant material, or landfill waste.

19. The co-fired combustion apparatus of claim 1, further comprising:

a first burner assembly configured to support the first combustion; and a burner support configured to support the first burner assembly in a housing.

20. A method of co-fired combustion comprising:

maintaining a first combustion by combusting a gaseous or liquid first fuel at a first combustion region having a portion defined by a first fuel-introducing body;

maintaining a second combustion by combusting a second fuel at a crucible located in a second combustion region, located above the first combustion region and having a portion defined by a second fuel-introducing body;

positioning the first combustion region relative to the second combustion region to cause the first combustion to provide heat to the second combustion reaction; and applying at least one first electrical potential, having a first value, proximate to the second combustion region;

wherein the first fuel produces a flame temperature that is sufficiently high to ignite combustion of the second fuel when a reaction activation energy of the second combustion is reduced by application of the first electrical potential.

21. The method of claim 20, further comprising:

applying at least one second electrical potential, having a second value, proximate to the first combustion region.

22. The method of claim 20, further comprising:

applying at least one second electrical potential at another location proximate to the second combustion region.

23. The method of claim 22, further comprising:

conveying a combustion product stream generated by at least the second combustion through a flue, stack or pipe.

24. The method of claim 22, wherein the other location proximate to the second combustion includes the crucible, the crucible is metallic, and the second electrical potential is applied to the crucible.

25. The method of claim 22, wherein the first fuel assembly is configured to produce a flame temperature that is at or above the autoignition temperature of the second fuel.

26. The method of claim 20, wherein an electrode assembly is operable to apply the at least one first electrical potential, and wherein the electrode assembly comprises one or more electrodes proximate to the second combustion region.

27. The method of claim 26, wherein the electrode assembly associated with the second combustion region is operable to increase combustion efficiency of the second combustion when the electrode assembly applies the one or more first electrical potential, compared to not applying the one or more first electrical potential.

28. The method of claim 20, wherein the second combustion produces a combustion product stream comprising particulates; and wherein the electrode assembly associated with the second combustion region is operable to increase combustion of the particulates in the combustion product stream when the electrode assembly applies the one or more first electrical potential.

29. The method of claim 20, wherein the second combustion produces a combustion product stream having a flow; and wherein applying the first electrical potential proximate to the second combustion region is operable to generate a combustion product stream flow having greater turbulence than another flow having substantially equal Reynolds number with no electrical potential applied.

30. The method of claim 20, further comprising introducing the second fuel to the second combustion region with a stoker.

31. The method of claim 20, wherein the second fuel is substantially solid.

32. The method of claim 20, wherein the second fuel includes one or more of rubber, wood, glycerin, an industrial waste stream, a post-consumer waste stream, an industrial by-product, garbage, hazardous waste, human waste, animal waste, animal carcasses, forestry residue, batteries, tires, waste plant material, or landfill waste material.

33. The method of claim 20, wherein the first fuel includes natural gas, propane, butane, or oil.

34. The method of claim 20, wherein the first combustion region is separated from the second combustion region.

35. The method of claim 20, wherein the first combustion region extends to overlap or occupy the second combustion region.

36. The method of claim 20, wherein the second fuel includes one or more of rubber, wood, glycerin, an industrial waste stream, a post-consumer waste stream, an industrial by-product, garbage, hazardous waste, human waste, animal waste, animal carcasses, forestry residue, batteries, tires, waste plant material, or landfill waste.

* * * * *